US005412289A

United States Patent [19]

Thomas et al.

[11] Patent Number: 5,412,289

[45] Date of Patent: May 2, 1995

[54] USING A MAGNETIC FIELD TO LOCATE AN AMALGAM IN AN ELECTRODELESS FLUORESCENT LAMP

[75] Inventors: Robert J. Thomas; Hsueh-Rong Chang, both of Schenectady, N.Y.

[73] Assignee: General Electric Company, Schenectady, N.Y.

[21] Appl. No.: 166,858

[22] Filed: Dec. 15, 1993

[51] Int. Cl.[6] ..... H05B 41/16

[52] U.S. Cl. ..... 315/248; 313/160; 313/490; 313/493; 315/344; 362/264; 445/26; 445/40; 445/42

[58] Field of Search ..... 445/13, 14, 26, 40, 445/42; 313/161, 572, 577, 490; 362/264; 315/248, 344

[56] References Cited

U.S. PATENT DOCUMENTS

| | | | |
|---|---|---|---|
| 3,689,508 | 9/1972 | Schoenewaldt | 549/217 |
| 4,010,400 | 3/1977 | Hollister | 315/248 |
| 4,145,634 | 3/1979 | Evans et al. | 313/490 |
| 4,182,748 | 1/1980 | Anderson | 423/579 |
| 4,262,231 | 4/1981 | Anderson et al. | 313/490 |
| 4,437,041 | 3/1984 | Roberts | 315/248 |
| 4,622,495 | 11/1986 | Smeelen | 315/248 |
| 4,972,118 | 11/1990 | Yorifuji et al. | 313/490 |
| 5,061,442 | 10/1991 | Ozimek | 420/526 |

FOREIGN PATENT DOCUMENTS

| | | | |
|---|---|---|---|
| 2330391 | 1/1975 | Germany | 313/490 |
| 58-55302 | 4/1983 | Japan . | |

OTHER PUBLICATIONS

"Electrodeless Fluorescent Lamp with Optimized Amalgam Positioning," by Borowitec et al., GE Docket No. RD-22,894, Ser. No. 08/130,935, filed Oct. 4, 1993.

"Accurate Placement and Retention of an Amalgam in an Electrodeless Fluorescent Lamp," by Borowitec et al., GE Docket No. RD-23,176, Ser. No. 08/131,221, filed Oct. 4, 1993.

*Primary Examiner*—Anita Pellman Gross
*Assistant Examiner*—Walter Malinowski
*Attorney, Agent, or Firm*—Jill M. Breedlove; Marvin Snyder

[57] ABSTRACT

An electrodeless SEF fluorescent discharge lamp of the type having an envelope with a re-entrant cavity formed therein for containing an excitation coil includes an amalgam positioned for maintaining an optimum mercury vapor pressure during lamp operation. The amalgam is doped with a magnetic material, such as iron, cobalt, nickel, aluminum or tungsten, and is initially located in an optimal operating position using a magnetic field generated by a magnet situated about the lamp envelope. Advantageously, the magnetic field can be used to relocate the amalgam within the exhaust tube, as desired, during lamp processing steps. After processing, the magnet is removed, and no amalgam holder is required.

9 Claims, 2 Drawing Sheets

USING A MAGNETIC FIELD TO LOCATE AN AMALGAM IN AN ELECTRODELESS FLUORESCENT LAMP

FIELD OF THE INVENTION

The present invention relates generally to electrodeless fluorescent lamps and, more particularly, to using a magnetic field to locate an amalgam doped with a magnetic material in such a lamp for controlling mercury vapor pressure therein.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (i.e., typically measured as power input per phosphor area) and in a fixture configuration to ensure operation of the lamp at or about a mercury vapor pressure of six millitorr (typically in a range from approximately four to seven millitorr); that is, the lamp and fixture are designed such that the coolest location (i.e., cold spot) of the fluorescent lamp is approximately 40° C. Compact fluorescent lamps, however, including electrodeless solenoidal electric field (SEF) fluorescent discharge lamps, operate at higher power densities with a cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing mercury from its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

Unfortunately, accurate placement and retention of an amalgam to achieve a mercury vapor pressure in the optimum range in an SEF lamp are difficult. For stable long-term operation, the amalgam should be placed and retained in a relatively cool location with minimal temperature variation.

Commonly assigned U.S. Pat. No. 4,262,231 of Anderson et al., issued Apr. 14, 1981, which is incorporated by reference herein, describes situating a lead-tin-bismuth amalgam in an electrodeless SEF fluorescent lamp by wetting the amalgam to a metal wire structure, such as a helical structure or a cylindrical screen, which is fixed within the tip-off region of a lamp envelope. Alternatively, Anderson et al. describe melting the amalgam onto an indium-coated, phosphor-free portion of the interior surface of the lamp envelope.

Smeelen U.S. Pat. No. 4,622,495 describes another scheme for locating an amalgam within an electrodeless SEF fluorescent lamp by attaching an amalgam holder to a tubular indentation (hereinafter referred to as a re-entrant cavity) within the lamp envelope. Disadvantageously, this requires a glass-to-metal seal; and a reliable glass-to-metal seal is difficult to achieve in manufacturing.

Accordingly, it is desirable to provide a relatively simple method for locating an amalgam in an electrodeless SEF fluorescent discharge lamp which provides an optimal operating location for the amalgam, while not requiring a glass-to-metal seal or an internal amalgam holder. Moreover, the amalgam should be held in place during lamp manufacturing without significantly interfering with other lamp processing steps.

SUMMARY OF THE INVENTION

An electrodeless SEF fluorescent discharge lamp of the type having an envelope with a re-entrant cavity formed therein for containing an excitation coil includes an amalgam positioned for maintaining an optimum mercury vapor pressure during lamp operation. The amalgam is doped with a magnetic material, such as iron, cobalt, nickel, aluminum or tungsten, including combinations thereof, and is initially located in an optimal operating position using a magnetic field generated by a magnet situated about the lamp envelope. Advantageously, the magnetic field can be used to relocate the amalgam within the exhaust tube, as desired, during lamp processing steps. After processing, the magnet is removed, and no amalgam holder is required.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
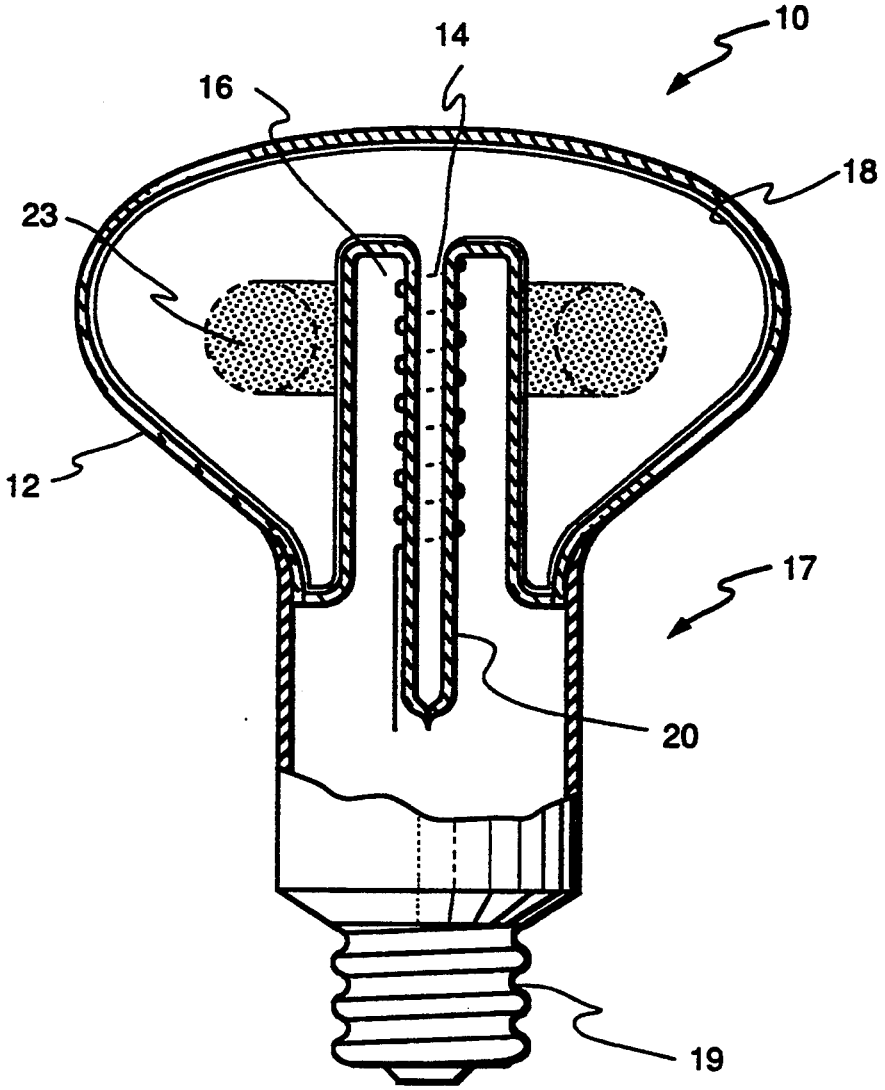
FIG. 1 illustrates, in partial cross section, a typical electrodeless SEF fluorescent lamp.

FIG. 1 illustrates a typical electrodeless SEF fluorescent discharge lamp 10 having an envelope 12 containing an ionizable gaseous fill. A suitable fill, for example, comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 20 which is used for filling the lamp. However, the coil may be spaced apart from the exhaust tube and wound about a core of insulating material or may be free-standing, as desired. The interior surfaces of envelope 12 are coated in well-known manner with a suitable phosphor 18. Envelope 12 fits into one end of a base assembly 17 containing a radio frequency power supply (not shown) with a standard (e.g., Edison type) lamp base 19 at the other end.

In operation, current flows in coil 14 as a result of excitation by a radio frequency power supply (not shown). As a result, a radio frequency magnetic field is established within envelope 12, in turn creating an electric field ionizes and excites the gaseous fill contained therein, resulting in an ultraviolet discharge 23. Phosphor 18 absorbs the ultraviolet radiation and emits visible radiation as a consequence thereof.

In accordance with the present invention, an amalgam is positioned in an optimal location in an SEF lamp for operation at a mercury vapor pressure in the optimum range from approximately four to seven millitorr. In particular, the amalgam is accurately positioned and retained at a relatively cool location with minimal temperature variation. To this end, an amalgam is doped with a magnetic material and is positioned in the lamp during lamp processing using a magnetic field generated by an external magnet. During processing steps, the amalgam may be moved and relocated, as desired. After lamp processing, the magnet is removed.

Examples of amalgams which may be doped with a magnetic material in accordance with the present invention comprise: a combination of bismuth and indium (e.g., 53%/47% Bi/In with 1.5–12% Hg); pure indium (with 6–12% Hg); a combination of lead, bismuth and tin (e.g., 32%/52.5%/15.5% Pb/Bi/Sn with 6–12% Hg); and a combination of indium, tin and zinc (e.g., 82.5%/16%/15% In/Sn/Zn with 1.5–6% Hg). Each amalgam has its own optimum range of operating temperatures. Hence, an optimal location for a particular amalgam depends on its composition.

The amount of magnetic material employed depends on the magnetic properties of the material and the effect the particular magnetic material has on the mercury vapor pressure when combined with a particular amalgam. The higher the magnetic permeability a material has, the less of that material is required. However, because doping an amalgam with a magnetic material does have an effect on mercury vapor pressure, the amount of magnetic material should be minimized. Suitable magnetic materials include, but are not limited to, iron, cobalt, nickel, aluminum and tungsten, including combinations thereof. For a typical amalgam mass on the order of about 100 milligrams, a suitable amount of magnetic material should be on the order from about 1 to 10 milligrams.

EXAMPLE

An approximately 100 mg amalgam comprising approximately 32 mg of lead, 52.5 mg of bismuth, and 15.5 mg of tin is doped with 1 mg of iron.

Figure 2:
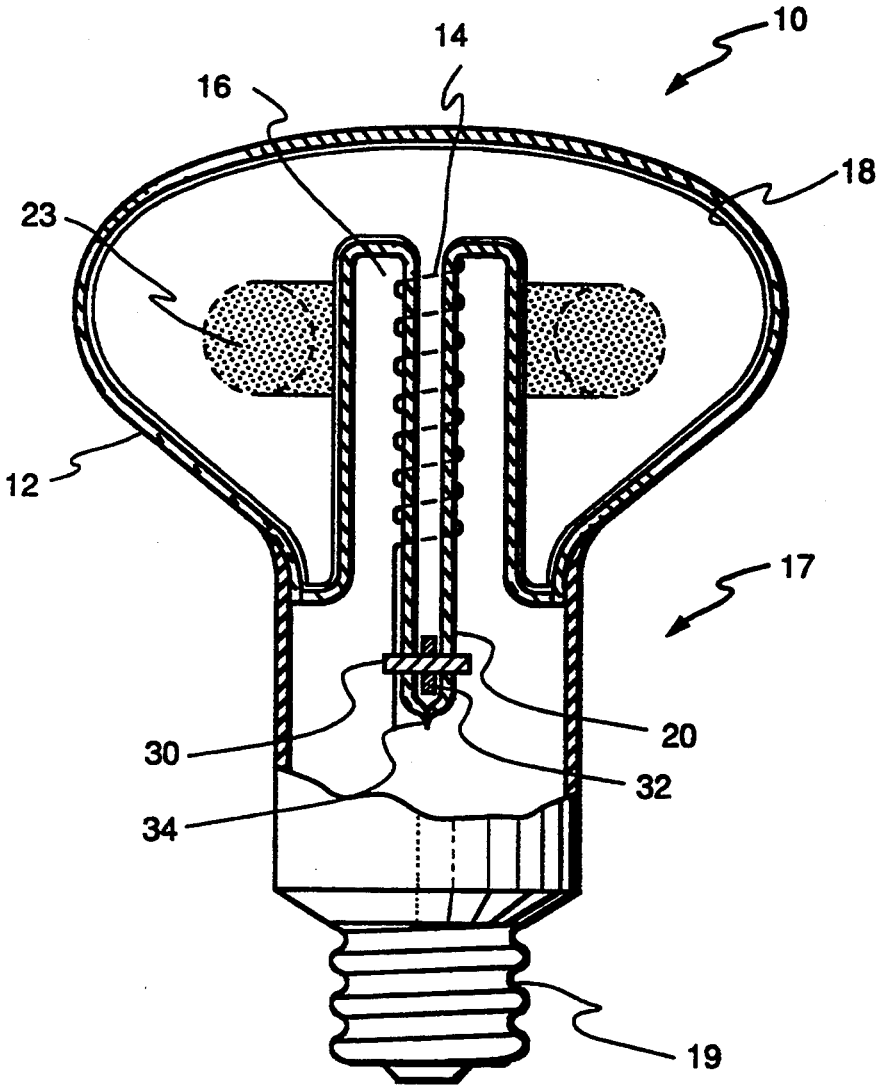
FIG. 2 illustrates, in partial cross section, an electrodeless SEF fluorescent lamp including an amalgam located within the lamp using a magnetic field in accordance with the present invention.

FIG. 2 illustrates the use of a magnetic field generated by an external magnet 30 for optimally locating an amalgam 32 which has been doped with a magnetic material in accordance with the present invention. In one embodiment, as shown in FIG. 2, the magnet is toroidal for surrounding exhaust tube 20 at the predetermined optimum location for amalgam 32.

During lamp processing, after the amalgam has been inserted into the exhaust tube, the lamp is evacuated and filled. Advantageously, since no internal amalgam holder is required using the amalgam location method of the present invention, the flow capacity of the exhaust tube is increased, shortening the time required for evacuating and filling the lamp through the exhaust tube during lamp processing. The exhaust tube is then sealed to form a tip 34 just below the optimum operating location for the amalgam.

As another advantage of the present invention, during lamp processing, amalgam 32 may be moved and temporarily relocated by moving the magnet, as desired. For example, during sealing of the exhaust tube (i.e., formation of the tip just below the optimum operating location for the amalgam), the amalgam can be moved away from the tip region and temporarily relocated using the magnet; once sealed, the amalgam can be moved back to its optimal location using the magnet. Ability to move the amalgam away from the location of the seal is advantageous because some of the amalgam, which would be in liquid form during high-temperature sealing, could otherwise leak out of the exhaust tube. Magnet 30 is later removed, and amalgam 32 remains substantially at its optimum location near the tip because the tip is the coolest location in the exhaust tube.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless solenoidal electric field (SEF) fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having a re-entrant cavity formed therein;

an excitation coil contained within said re-entrant cavity for providing said radio frequency magnetic field when excited by a radio frequency power supply;

an exhaust tube extending through said re-entrant cavity, said exhaust tube having one end opening into said envelope and another end having a tip; and an amalgam situated within said exhaust tube and maintained in a predetermined position toward said tip of said exhaust tube, said amalgam comprising a magnetic material in combination with at least one metal and mercury, said amalgam being initially located in said exhaust tube by an externally generated magnetic field.

2. The SEF lamp of claim 1 wherein said predetermined location is such that mercury vapor pressure within said envelope is maintained within the range from approximately four to seven millitorr during lamp operation.

3. The SEF lamp of claim 1 wherein said at least one metal is selected from the group consisting of lead, bismuth, indium, tin and zinc, including combinations thereof.

4. The SEF lamp of claim 1 wherein said magnetic material is selected from the group consisting of iron, cobalt, nickel, aluminum and tungsten, including combinations thereof.

5. A method for manufacturing an electrodeless solenoidal electric field (SEF) fluorescent discharge lamp, comprising the steps of:

providing a light-transmissive envelope having an interior phosphor coating for emitting visible radiation when excited by ultraviolet radiation, said envelope having a re-entrant cavity formed therein for containing an excitation coil, said re-entrant cavity having an exhaust tube extending therethrough, said exhaust tube having one end opening into said envelope and another end having a tip region;

providing an amalgam comprising a combination of at least one metal, mercury and a magnetic material;

locating said amalgam at a predetermined location toward said tip region of said exhaust tube using a magnetic field generated externally of said exhaust tube;

evacuating and filling said envelope through said exhaust tube; and sealing said tip region of said exhaust tube to form a tip.

6. The method of claim 5 wherein said predetermined location is such that mercury vapor pressure within said envelope is maintained within the range from approximately four to seven millitorr during lamp operation.

7. The method of claim 5 wherein said at least one metal is selected from the group consisting of lead, bismuth, indium, tin and zinc, including combinations thereof.

8. The method of claim 5 wherein said magnetic material is selected from the group consisting of iron, cobalt, nickel, aluminum and tungsten, including combinations thereof.

9. The method of claim 5, further comprising the step of:

using said magnetic field to move said amalgam farther from said tip region than said predetermined location in order to increase the distance between said amalgam and said tip region during said sealing step, said amalgam being moved to said predetermined location after said sealing step.

* * * * *